United States Patent [19]

Kobayashi

[11] 4,450,439

[45] May 22, 1984

[54] COLOR VIDEO DATA DISPLAY APPARATUS

[75] Inventor: Katsumi Kobayashi, Machida, Japan

[73] Assignee: Sony Corporation, Tokyo, Japan

[21] Appl. No.: 317,178

[22] Filed: Nov. 2, 1981

[30] Foreign Application Priority Data

Nov. 6, 1980 [JP] Japan ..... 55-156241

[51] Int. Cl.[3] ..... G09G 1/28

[52] U.S. Cl. ..... 340/703; 340/745; 340/730

[58] Field of Search ..... 340/701, 703, 730, 721, 340/745, 744

[56] References Cited

U.S. PATENT DOCUMENTS 3,284,663 11/1966 Stocker ..... 340/701
3,911,418 10/1975 Takeda ..... 340/703
4,016,544 4/1977 Morita et al. ..... 340/703
4,149,184 4/1979 Giddings et al. ..... 340/730

*Primary Examiner*—Marshall M. Curtis
*Attorney, Agent, or Firm*—Lewis H. Eslinger; Alvin Sinderbrand

[57] ABSTRACT

A display apparatus includes a video signal input terminal supplied with a first video signal to be displayed; a plurality of video signal amplifiers, each producing an output signal as a primary color signal; a sync signal generating means for generating a sync signal corresponding to the first video signal; a signal generating circuit for generating a second video signal having a predetermined constant amplitude during the horizontal period; a first circuit for supplying the first video signal to at least one of the video signal amplifiers; and a second circuit for supplying the second video signal to at least one different video signal amplifier.

7 Claims, 6 Drawing Figures

COLOR VIDEO DATA DISPLAY APPARATUS

BACKGROUND OF THE INVENTION

1. Field of the Invention

The present invention relates generally to a display apparatus for displaying a monochrome signal from a computer as a character or the like, and more particularly, to a display apparatus in which the background of the character is colored to make the displayed character stand out from the contrasting color of the background and also to increase the amount of light from the entire screen thereby making the display more easily seen.

2. Description of the Prior Art

With a prior art display apparatus using a cathode ray tube, in order to avoid a blooming (defocusing) of the electron beam of the cathode ray tube and thereby sharply display a character, the cathode ray tube is driven at a low level. As a result, the picture screen is often not bright enough. Since the objects to be displayed are a character or the like, the dark portion of the screen is relatively large, making the average brightness of the picture level relatively low, and hence, the absolute amount of light from the entire picture screen low. This fact plus the relatively low driving level of the cathode ray tube and its associated reduced brightness level cause the picture screen to be dark.

OBJECTS AND SUMMARY OF THE INVENTION

Accordingly, an object of the present invention is to provide a display apparatus free from the defects encountered in the prior art.

Another object of the present invention is to provide a display apparatus in which, with a simple construction, the background of a displayed character is colored to make the picture screen bright and clearly to display the character.

In accord with the present invention, a display apparatus comprises a video signal input terminal supplied with a first video signal to be displayed, the first video signal having a horizontal period, a plurality of video signal amplifiers, each producing an output signal as a primary color signal, sync signal generating means for generating a sync signal corresponding to the first video signal, signal generating means for receiving the sync signal and generating a second video signal having a predetermined constant amplitude during the horizontal period, first means for supplying the first video signal to at least one of the video signal amplifiers, second means for supplying the second video signal to at least another of the video signal amplifiers, and summing means for selectively summing the first and the second video signals and supplying the summed signal to at least one of the video signal amplifiers.

The above, and other objects, features and advantages of the present invention will be apparent from the following detailed description of illustrative embodiments thereof which is to be read in connection with the accompanying drawings.

DESCRIPTION OF THE PREFERRED EMBODIMENTS

Figure 1:
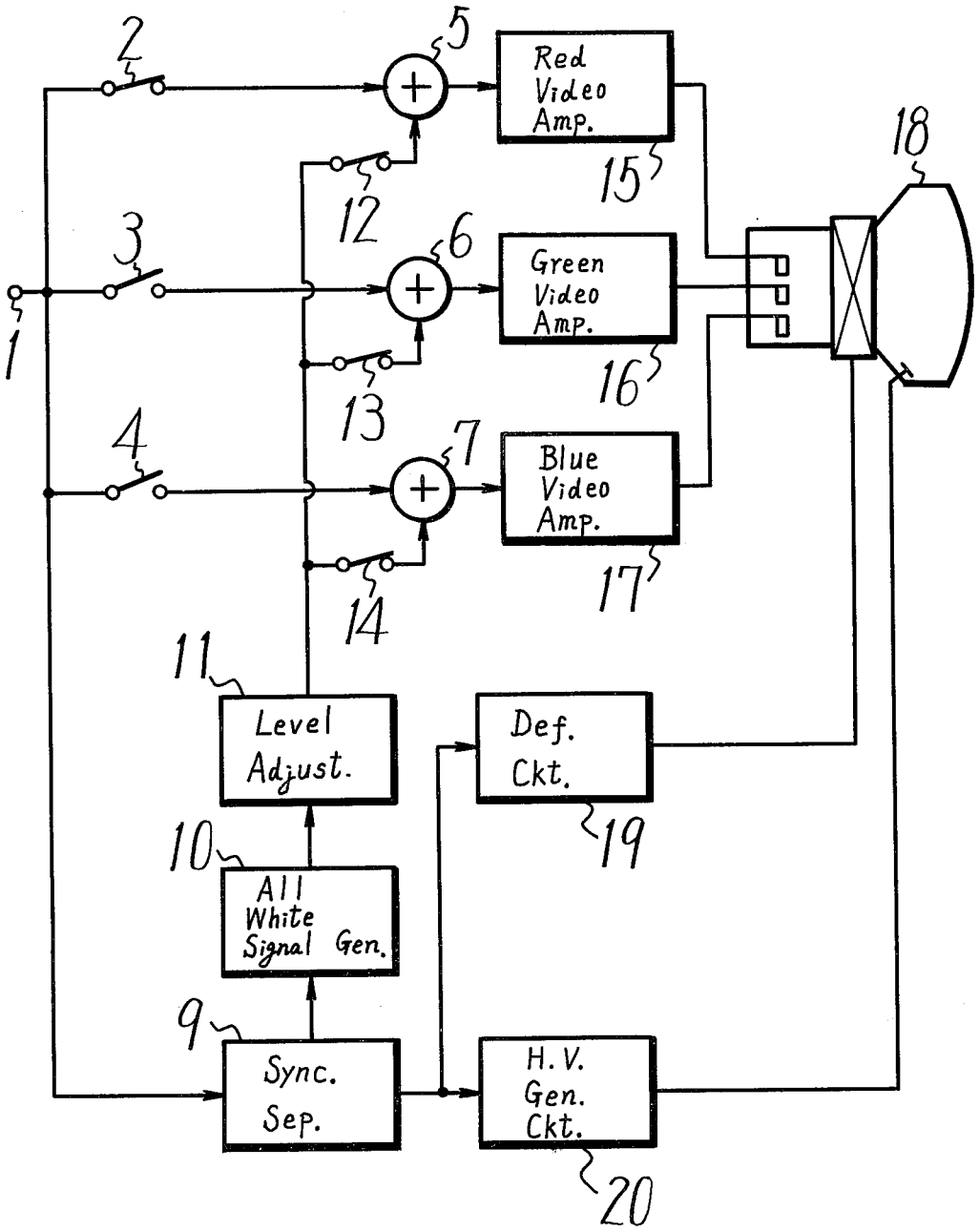
FIG. 1 is a block diagram illustrating an embodiment of a display apparatus according to the present invention.

In the embodiment of the invention illustrated in FIG. 1, 1 designates an input terminal to a video signal which can be, for example, a monochrome video signal for displaying a character or the like from a CPU (central processing unit) of a computer (not shown). The monochrome video signal applid to input terminal 1 is supplied through switches 2, 3 and 4 to first input terminals of OR circuits 5, 6 and 7 and also to a synchronous separating circuit 9. The synchronizing signal separated by circuit 9 and delivered therefrom is fed to an all-white signal generating circuit 10, which then generates a video signal (referred to hereinafter as an all-white signal) which is a predetermined amplitude level, for example 100 IRE units (Institute of Radio Engineer) during a horizontal scanning period. The all-white signal from circuit 10 is fed to a level adjusting circuit 11 which adjusts the amplitude level of the all-white signal. The all-white signal from level adjusting circuit 11 is supplied through switches 12, 13 and 14 to second input terminals of OR circuits 5, 6 and 7, respectively.

The outputs from OR circuits 5, 6 and 7 are fed through video amplifier circuits 15, 16 and 17, respectively, to a color cathode ray tube 18. In this case, video amplifier circuits 15, 16 and 17 correspond to chromaticity signals of red, green and blue colors, respectively.

The synchronizing signal from synchronous separating circuit 9 is also applied to a deflecting circuit 19 and a high voltage generating circuit 20. The deflecting output from the former and the high voltage from the latter are both supplied to color cathode ray tube 18.

With the display apparatus described above, when the data from, for example, a CPU of a computer are displayed on color cathode ray tube 18, at least one of switches 2, 3 and 4 must be switched ON. For example, if switch 2 is switched ON, as illustrated in FIG. 1, the data or monochrome video signal from the CPU of the computer is supplied through switch 2, OR circuit 5 and video amplifier circuit 15 to color cathode ray tube 18 where the data are displayed.

If at least one of switches 2, 3 and 4 is closed and at least one of switches 12, 13 or the like 14 is closed, the background of the character and displayed on color cathode ray tube 18 can be colored. For example, if switches 12, 13 and 14 are all closed as shown in FIG. 1, the background is white.

A monochrome video signal applied to input terminal 1 is fed to synchronous separating circuit 9 where the synchronizing signal is separated. All-white signal generating circuit 10 generates an all-white signal based upon the separated synchronizing signal. The all-white signal is supplied through switch 12, OR circuit 5 and video amplifier circuit 15, switch 13, OR circuit 6 and video amplifier circuit 16, and switch 14, OR circuit 7 and video amplifier circuit 17 to color cathode ray tube 18 so that the background is white.

Since the all white signal has a predetermined amplitude level during the horizontal scanning period, the chromaticity signals corresponding to red, green and blue colors are supplied from video amplifiers 15, 16 and 17 to color cathode ray tube 18 during the horizontal scanning period. Therefore, all the area of the picture screen of color cathode ray tube 18 except for the character display portion (on which the character and so on are displayed, i.e., the background of the character or the like) becomes white. The all-white signal superimposed on the monochrome video signal at OR circuit 5 is supplied to color cathode ray tube 18, so that the character display portion is displayed in a red color.

With the embodiment of the invention of FIG. 1, when switches 2, 12, 13 and 14 are made ON and switches 3 and 4 are mde OFF, as depicted in FIG. 1, a red character or the like is displayed on a white background.

Similarly, if any one of switches 2, 3 and 4 is closed and the states of switches 12, 13 and 14 are selected as shown in Table 1, the color of the background can be selected as red, green, blue, yellow, magenta, cyan and white.

TABLE 1

| | | COLOR OF BACKGROUND | | | | | | |
|---|---|---|---|---|---|---|---|---|
| | | RED | GREEN | BLUE | YELLOW | MAGENTA | CYAN | WHITE |
| STATE OF SWITCH | SWITCH 12 | ON | OFF | OFF | ON | ON | OFF | ON |
| | SWITCH 13 | OFF | ON | OFF | ON | OFF | ON | ON |
| | SWITCH 14 | OFF | OFF | ON | OFF | ON | ON | ON |

Figure 2A:
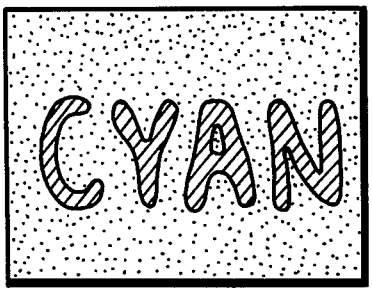
FIGS. 2A, 2B and 2C are diagrams illustrating characters displayed by the apparatus of FIG. 1.
Figure 2B:
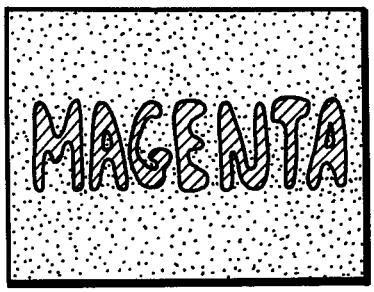
Figure 2C:
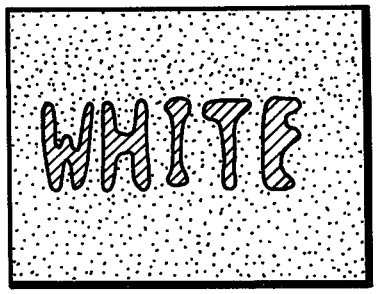

The color of the character or the like displayed on the picture screen of the color cathode ray tube can be determined by the color of the background which is determined by the positions of switches 12, 13 and 14, and the positions of switches 2, 3 and 4. For example, if switches 3 and 14 are made ON, the video signal for displaying the character or the like is supplied to color cathode ray tube 18 as a green chromaticity signal while the all-white signal is also applied to color cathode ray tube 18 as a blue chromaticity signal. Therefore, as shown in FIG. 2A, cyan color characters or the like are displayed on a blue color background on the screen of color cathode ray tube 18. If switches 2 and 14 are made ON, the video signal for displaying a character or the like is supplied to color cathode ray tube 18 as a magenta chromaticity signal, while the all-white signal is supplied to color cathode ray tube 18 as a blue chromaticity signal. Therefore, as shown in FIG. 2B, magenta color characters and the like are displayed on a blue color background on the screen of color cathode ray tube 18. Further, if switches 2 and 3 are both made ON and then switch 14 is made ON, as shown in FIG. 2C, white color characters and the like are displayed on a blue color background on the screen of color cathode ray tube 18.

According to the above embodiment of the present invention, when a character or the like is displayed on color cathode ray tube 18 based upon a monochrome video signal delivered from, for example, the CPU of a computer, the color of the displayed portion such as the character or the like can be different from that of the background. As a result, the hue difference between the characters and the background makes the characters more easily seen. Since the background is colored, the display picture screen becomes bright and hence easily seen. When the total amount of light from a character or the like displayed by the prior art green light is compared with the light output in each of the examples of FIGS. 2A, 2B and 2C according to the invention, the superior brightness of the screen is easily illustrated. The average picture level of a character or the like is 10%, and the brightness of each of the blue, red and green colors is taken as 0.1:0.3:0.6, the same as the luminosity factor. The total amount of light by the prior art display in a green color is as follows:

$$0.6\times(10/100)=0.06$$

According to the embodiment of the present invention as illustrated in FIG. 1, the total amount of light is as follows:

For FIG. 2A, $$(0.6\times(10/100))+(0.1\times(100/100))=0.16$$

For FIG. 2B

$$(0.3\times(10/100))+(0.1\times(100/100))=0.13$$

For FIG. 2C

$$(0.6\times(10/100))+(0.1\times(100/100))+(0.3\times(10/100))-=0.19$$

From the numbers calculated above, it is apparent that the total amount of light from a display according to the invention when compared with a green color prior art display is 2.67, 2.17, and 3.17 times, as illustrated in FIGS. 2A, 2B and 2C.

According to the display apparatus of the present invention while the monochrome video signal for displaying a character or the like is supplied to color cathode ray tube 18 as a predetermined chromaticity signal, the all white signal prepared from the synchronizing signal is supplied to color cathode ray tube 18 as a chromaticity signal which is different than the predetermined chromaticity signal as determined above. Accordingly, the color of the display portion for the character or the like can be selected to be a different hue from that of the background, so that the character or the like can be clearly displayed. Further, since the background is colored, the amount of light of the entire picture screen can be increased and hence, the display is much more easily seen.

Another embodiment of a display apparatus according to the present invention will be described with reference to FIG. 3 in which the same reference numerals of FIG. 1 designate the same or like elements.

Figure 3:
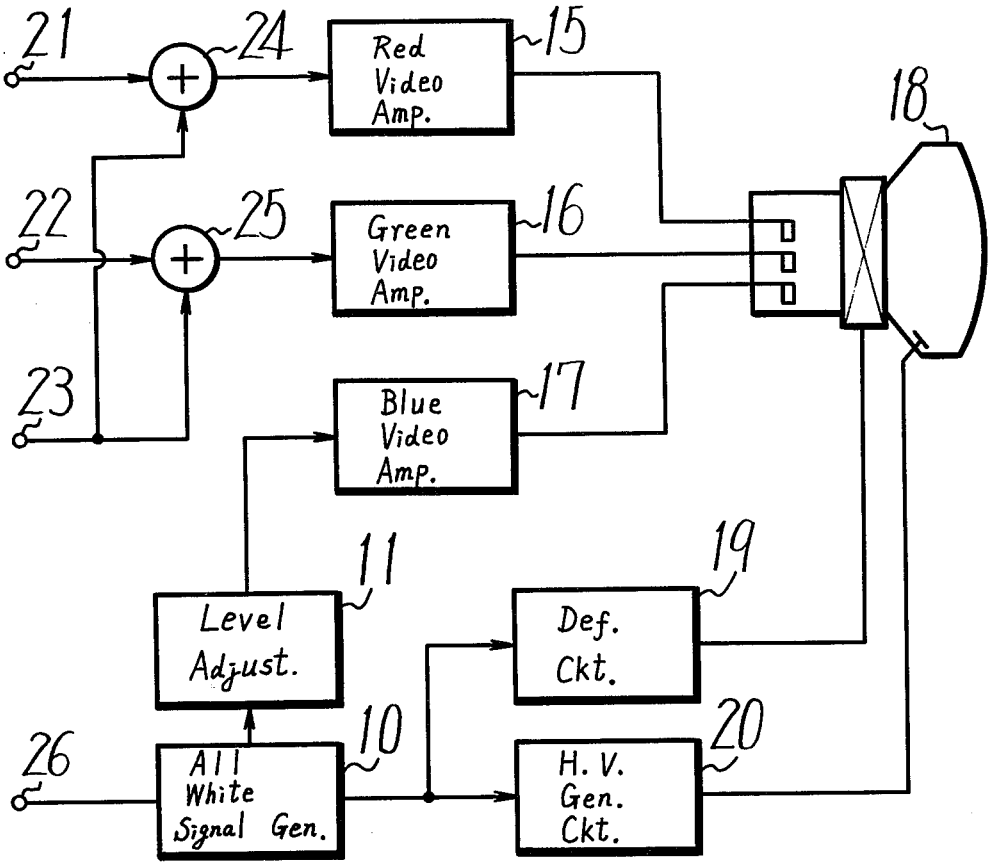
FIG. 3 is a block diagram illustrating an alternate embodiment of a display apparatus in accord with the present invention.

In FIG. 3, input terminals 21, 22, 23 are each supplied with one of three different monochrome video signals from, for example, the CPU of a computer (not shown). In the illustrated embodiment, three different monochrome video signals can correspond to three different kinds of data. If the video signals are supplied to color cathode ray tube 18 as different chromaticity signals, the different kinds of data can be positively discriminated by color.

With the embodiment of FIG. 3, the monochrome video signal applied to input terminal 21 is supplied to color cathode ray tube 18 through an OR circuit 24 and video amplifier circuit 15. The monochrome video signal applied to input terminal 22 is supplied to color cathode ray tube 18 through an OR circuit 25 and video amplifier circuit 16. The signal supplied to input terminal 23 is supplied to color cathode ray tube 18 through OR circuit 24 and video amplifier circuit 15 and also through OR circuit 25 and video amplifier circuit 16.

In FIG. 3, an external synchronizing signal is applied to input terminal 26 and is supplied to all-white signal generating circuit 10. The all-white signal derived from circuit 10 is supplied to color cathode ray tube 18 through level adjusting circuit 11 and video amplifier circuit 17.

Figure 4:
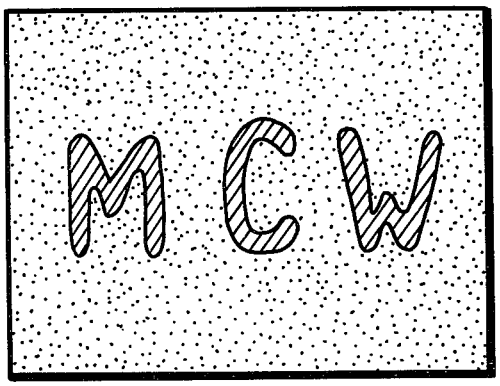
FIG. 4 is a diagram illustrating characters displayed by the apparatus of FIG. 3.

In the embodiment of FIG. 3, a monochrome video signal for displaying a character "M" (see FIG. 4) is supplied to input terminal 21. The video signal corresponding to the character "M" is supplied to color cathode ray tube 18 as a red chromaticity signal. An all-white signal is supplied to color cathode ray tube 18 as a blue chromaticity signal. Accordingly, the character "M" shown in FIG. 4 is displayed in a magenta color on a blue background. Similarly, the characters "C" and "W" shown in FIG. 4 are displayed as cyan color and white color on a blue background, respectively. Thus, it will be understood that the same display can be obtained with the embodiment shown in FIG. 1 as can be obtained by the embodiment shown in FIG. 3.

The total light amount from the picture screen of the embodiment shown in FIG. 3 can also be compared with the prior art. In the prior art, it is assumed that three kinds of data are displayed with red, green and blue colors and the average picture levels at the red, green and blue color character portions is $10\% \times \frac{1}{3}$, and that the brightness of the red, green and blue is 0.1:0.3:0.6. The total amount of light is calculated as follows:

$$(0.3\times(10/100)\times\tfrac{1}{3})\times(0.6\times(10/100)\times\tfrac{1}{3})+(0.1\times(10/100)\times\tfrac{1}{3})=0.033$$

The total amount of light from the embodiment shown in FIG. 3 is calculated as follows:

$$[(0.3+0.1)\times(10/100)\times\tfrac{1}{3}]+[(0.6+0.1)\times(10/100)\times\tfrac{1}{3}]+[0.3+0.6+0.1)\times(10/100)\times\tfrac{1}{3}]+[0.1\times(90/100)]=0.1596$$

From the above, calculations, it is apparent that the total amount of light from the embodiment of FIG. 3 is about 4.83 times that of the prior art.

In the embodiment shown in FIG. 3, video amplifier circuits 15, 16 and 17 correspond to red, green and blue chromaticity signals and the data are displayed as magenta, cyan and white colors on a blue background for easy discrimination. It, however, may be easily understood that if the mixing of the chromaticity signals is varied by a switch, the data can be displayed on a predetermined background color with seven different colors of characters, i.e., red, green, blue, yellow, magenta, cyan and white.

In known devices when the data are displayed in one of seven colors by a display apparatus having red, green and blue color emitting bodies, the luminosity factor of the blue color is low so that when a thin character or the like is displayed, the displayed character is not sharp. To avoid this, a display apparatus provided with red, green and white color emitting bodies can be utilized. According to such a display apparatus, the display is performed with the color white instead of the color blue, so that the display is sharp. However, with such a device, only three colors can be used for the display.

According to the embodiment of the invention shown in FIG. 3, the data can be displayed in one of three colors comprising magenta, cyan and white on a blue background. Since three primary colors, i.e. red, green and blue color light emitting bodies are used, it is also possible to display the data in one of the seven colors listed above.

In the above described embodiments of a invention, the color cathode ray tube is used in the display apparatus. The invention can also be applied to a three-tube type display apparatus such as a three-tube projector to obtain the same effects.

Although specific embodiment of the present invention have been described in detail herein with reference to the accompanying drawings, it is to be understood that the invention is not limited to those precise embodiments, and that various further modifications may be effected therein by one skilled in the art without departing from the spirit and scope of the invention as defined in the appended claims.

I claim as my invention:

1. A display apparatus comprising:

a video signal input terminal supplied with a first video signal to be displayed, said first video signal having a horizontal period and containing a sync signal;

a plurality of video signal amplifiers, each producing an output signal as a primary color signal;

sync signal separating means for separating said sync signal from said first video signal;

signal generating means for receiving said sync signal and generating a second video signal therefrom having a predetermined constant amplitude during said horizontal period;

first means for supplying said first video signal to at least one of said video signal amplifiers;

second means for supplying said second video signal to at least another of said video signal amplifiers; and selectively operable summing means for selectively summing said first and second video signals and supplying the summed signal to at least a selected one of said video signal amplifiers.

2. A display apparatus as claimed in claim 1, wherein said sync signal generating means comprises a sync separator connected to said video signal input terminal.

3. A display apparatus as claimed in claim 1, wherein said plurality of video signal amplifiers are three primary color video amplifiers which produce red, green and blue color signals.

4. The display apparatus of claim 1; wherein said first means for supplying includes first switch means connected between said video signal amplifiers and said video signal input terminal.

5. The display apparatus of claim 4; wherein said second means for supplying includes second switch means connected between said video signal amplifiers and said signal generating means.

6. The display apparatus of claim 5; and further comprising means connected between said first and second switch means and said video signal amplifiers for supplying said first and second video signals to said video signal amplifiers.

7. The display apparatus of claim 6; wherein each of said first and second switch means includes a switch connected to each of said video signal amplifiers.

* * * * *